US007060143B1

(12) United States Patent
Eiban et al.

(10) Patent No.: US 7,060,143 B1
(45) Date of Patent: Jun. 13, 2006

(54) METHOD AND DEVICE FOR APPLYING WRAP-AROUND LABELS TO OBJECTS

(75) Inventors: Gunter Eiban, Regensburg (DE); Herman Englbrecht, Alteglofsheim (DE); Erich Eder, Donaustauf (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 09/701,927

(22) PCT Filed: Apr. 28, 2000

(86) PCT No.: PCT/EP00/03872

§ 371 (c)(1),
(2), (4) Date: Jan. 16, 2001

(87) PCT Pub. No.: WO00/66437

PCT Pub. Date: Nov. 9, 2000

(30) Foreign Application Priority Data

| | | |
|---|---|---|
| Apr. 30, 1999 | (DE) | 199 19 880 |
| May 6, 1999 | (DE) | 199 20 905 |
| Jan. 20, 2000 | (DE) | 100 02 401 |

(51) Int. Cl.

| | |
|---|---|
| ***B65C 3/08*** | (2006.01) |
| ***B65C 3/14*** | (2006.01) |
| ***B65C 9/00*** | (2006.01) |
| ***B65C 9/26*** | (2006.01) |

(52) U.S. Cl. ..... 156/86; 156/213; 156/215; 156/229; 156/494; 156/566; 156/567; 156/DIG. 9; 156/DIG. 12; 156/DIG. 25; 156/DIG. 27; 156/DIG. 37; 53/585

(58) Field of Classification Search ..... 264/230, 264/342 R; 156/213, 215, 293, 229, 494, 156/DIG. 9, DIG. 24; 53/399, 585
See application file for complete search history.

(56) References Cited

U.S. PATENT DOCUMENTS

| | | | | |
|---|---|---|---|---|
| 3,523,052 | A * | 8/1970 | Bolen | 156/521 |
| 3,839,125 | A * | 10/1974 | Horvath | 156/481 |
| 4,102,728 | A * | 7/1978 | Smith | 156/362 |
| 4,144,631 | A * | 3/1979 | Fujio | 29/446 |
| 4,243,466 | A | 1/1981 | Lindee | |
| 4,286,421 | A * | 9/1981 | Fujio | 53/399 |
| 4,357,788 | A | 11/1982 | Amberg | |
| 4,412,876 | A * | 11/1983 | Lerner et al. | 156/64 |
| 4,620,888 | A * | 11/1986 | Easter et al. | 156/64 |

(Continued)

FOREIGN PATENT DOCUMENTS

| | | |
|---|---|---|
| DE | 2950785 | 6/1981 |
| EP | 0 584516 | 3/1994 |

*Primary Examiner*—Melvin Mayes
(74) *Attorney, Agent, or Firm*—Marshall, Gerstein & Borun LLP

(57) ABSTRACT

The invention concerns a process and a device for attaching a label jacket to objects, such as bottles or similar items, where a jacket label is seized by its forward margin by a spreading jaw unit and pulled in axial direction over the object, where the object, before the pull-over application, is held by the area of its mantle surface, by positive and/or friction lock, the pull-over process is started, the holding device on the mantle surface is temporarily released as soon as the spreading jaw unit at least partially surrounds the object at its mantle surface, and, at the latest before the desired adhesion height of the label jacket on the object is reached, the latter objects is again seized by the area of its mantle surface, which is now covered with the label, and in the process the label is affixed in a non-slip manner, while the spreading jaw unit is pulled off.

36 Claims, 12 Drawing Sheets

U.S. PATENT DOCUMENTS 5,060,367 A * 10/1991 Vandevoorde ..... 29/775
5,417,794 A * 5/1995 Menayan ..... 156/362
5,483,783 A * 1/1996 Lerner et al. ..... 53/399
5,607,045 A 3/1997 Hermann Kronseder
5,715,651 A * 2/1998 Thebault ..... 53/399
6,263,940 B1 * 7/2001 Menayan ..... 156/556
6,474,390 B1 * 11/2002 Vandevoorde ..... 156/494
6,543,514 B1 * 4/2003 Menayan ..... 156/540

* cited by examiner

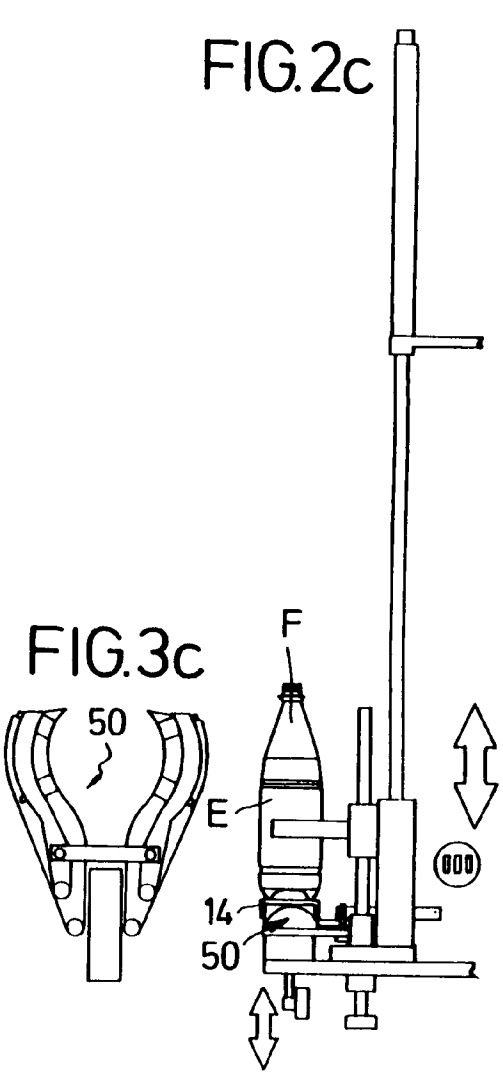
FIG.2c
FIG.3c
F
E
14
50
50
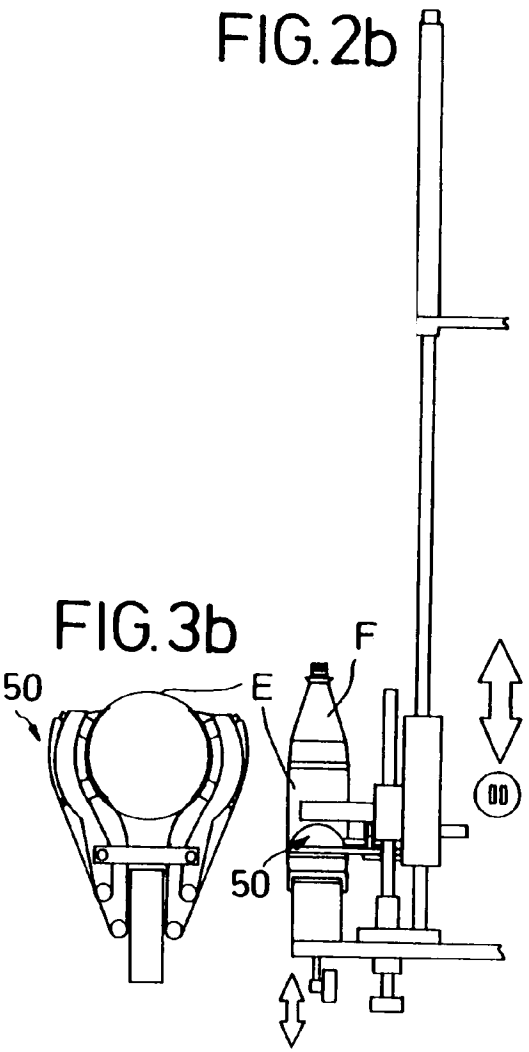
FIG.2b
FIG.3b
F
E
50
50
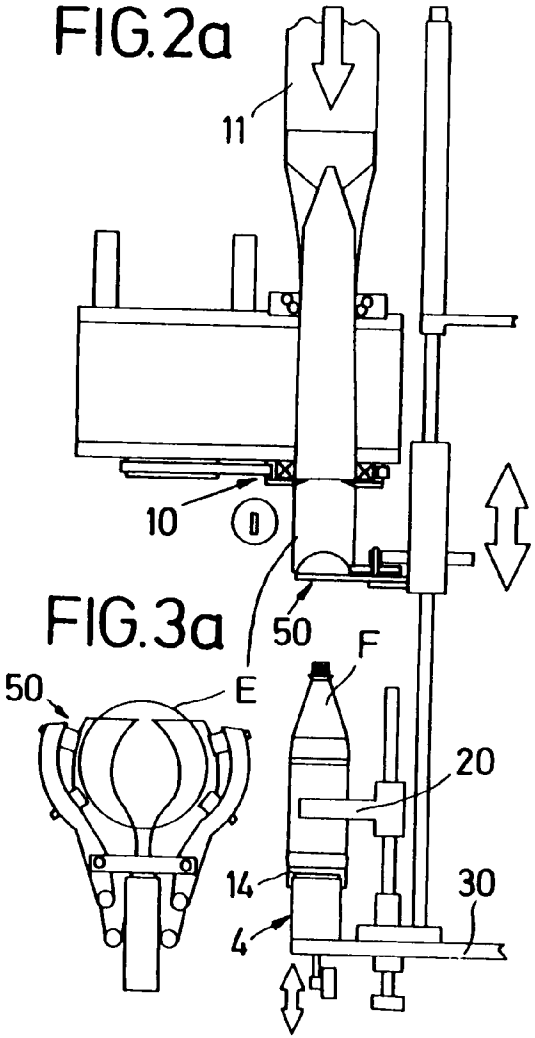
FIG.2a
FIG.3a
11
10
50
20
30
F
E
14
4
50

METHOD AND DEVICE FOR APPLYING WRAP-AROUND LABELS TO OBJECTS

REFERENCE TO RELATED APPLICATIONS

This disclosure claims the benefit of the filing date of International Application No. PCT/EP00/03872, having an international filing date of Apr. 28, 2000, which designated the United States of America, and this disclosure is the United States national stage of that international application. This disclosure further claims priority to Germany patent application 199 19 880.2, filed Apr. 30, 1999, Germany patent application 199 20 905.7, filed May 6, 1999, and Germany patent application 100 02 401.7, filed Jan. 20, 2000.

FIELD OF THE INVENTION

The invention relates to a process and a device for the attachment of label jackets to products such as bottles.

BACKGROUND OF THE INVENTION

A corresponding machine is known from European Patent No. 0 584 516. This machine has a revolving table, with dishes that are arranged at regular intervals on a common sector of a circle, for the free standing uptake of bottles. On each one of these dishes, a roll of labeling hose, an installation for the separation of label jackets, and a pair of separating jaws that can be lowered and lifted for seizing the separated label jackets and to pull them over a bottle, are arranged in a manner so that they rotate.

The drawbacks of this construction design are the considerable cost and the fact that replacement of the numerous rolls of label hose is time consuming. Because of the free standing bottles, the speed of revolution and thus the production output are considerably limited. Furthermore, on the one hand, the evenness of the height of attachment of the label jackets to a multitude of bottles is unsatisfactory, and, on the other hand, the operating reliability is critical, especially when the external wall of the bottles are wetted with a fluid. These drawbacks are connected with the fact that a label jacket, at the time when the force of friction between the label and the bottle is greater than between the separating jaws and the label, stops the axial relative movement with respect to the bottle and adheres to it. The height of attachment of the individual jacket labels depends on the individual friction conditions and, therefore, it is not exactly defined. Moreover, the operating reliability is problematic when the separating jaws return to their original upper starting position, because there are still bottles on the support dishes.

SUMMARY OF THE INVENTION

The invention is based on the task of providing a process and a device with high fitting precision and operating reliability.

According to the invention, the bottles are seized, before a label jacket is pulled over them, in the area of their mantle surface, until the separating jaw pair which holds a label jacket, coming from above, surrounds, in a manner which is known in itself, at least for a portion of the longitudinal extent of the bottle to be fitted. In the subsequent course of the operation, the holding device for holding the bottles by their mantle surface is temporarily released, and the label jacket is pulled by the separating jaw pair, with simultaneous support of the bottom of the bottle, to the desired final position, where the lowering movement of the separation jacket pair is then stopped, while the label jacket continues to be held at its lower edge with friction lock by the separating jaws. Then the bottle is again seized by a part of its mantle surface which in the meantime has been covered with the label jacket that has been pulled over it, where the label jacket is held by friction lock or pressed against the external side of the bottle. The separating jaw pair releases the hold grip on the forward lower margin of the label jacket only then, and it is then lowered completely under the standing surface of the bottle. During this lowering movement of the separation jaw pair, the label jacket, advantageously, can no longer change its height position on the bottle, so that the position of the label jacket with respect to the bottom of the bottle is maintained uniformly with great precision in the case of a multitude of bottles, that is the height position tolerances of the height of adhesion can be kept in a very small range.

Advantageously, the separation jaw pair is designed in such a manner that its coupling action, with friction lock, is simultaneously applied to the radial internal and the external surface, and, as a result, it is possible to avoid an unnecessary large widening of a label jacket to generate sufficient frictional forces.

Since, in the proposed process, a bottle is supported at all times by its circumference, before, during and after the pull-over application of a label jacket, by an area of its mantle surface, high speeds of rotation can be achieved with an accordingly high production output without tipping of the bottle.

According to an embodiment variant of the invention, the separation jaw pair is lifted into the original upper position, only after the removal transport of the bottles that have been provided with a label jacket from a bottom dead center position, so that, advantageously, no disturbances can be caused by collision with a bottle or jamming of the separation jaws.

A particularly advantageous embodiment is one where the movements in height of the clamp jaw pair for pulling on the label jacket and for the return movement into the starting position is controlled by a cam control, but caused by a working cylinder or another appropriate drive (engine, etc.), because, as a result, the processing times, particularly the return time to the initial position, can be kept shorter than with a pure cam control, because there is no risk of self inhibition. The angle of rotation of the revolving table required for a complete cycle of movement of the clamp jaws is, accordingly, reduced, that is a smaller revolving table diameter is sufficient, with the same output level.

BRIEF DESCRIPTION OF THE DRAWINGS

Below, a preferred embodiment of the invention is explained with reference to the figures. In the drawing:

FIGS. 2*a*–2*c* show a vertical cross section through the revolving table of FIG. 1 seen in the direction of the arrow A, in different operating positions, FIGS. 3*a*–3*c* show a diagrammatic top view of a separation jaw pair to seize and pull over label jackets in different operating positions, corresponding to the series of FIGS. 2*a*–2*c*.

DETAILED DESCRIPTION OF THE PREFERRED EMBODIMENT

Figure 1A:
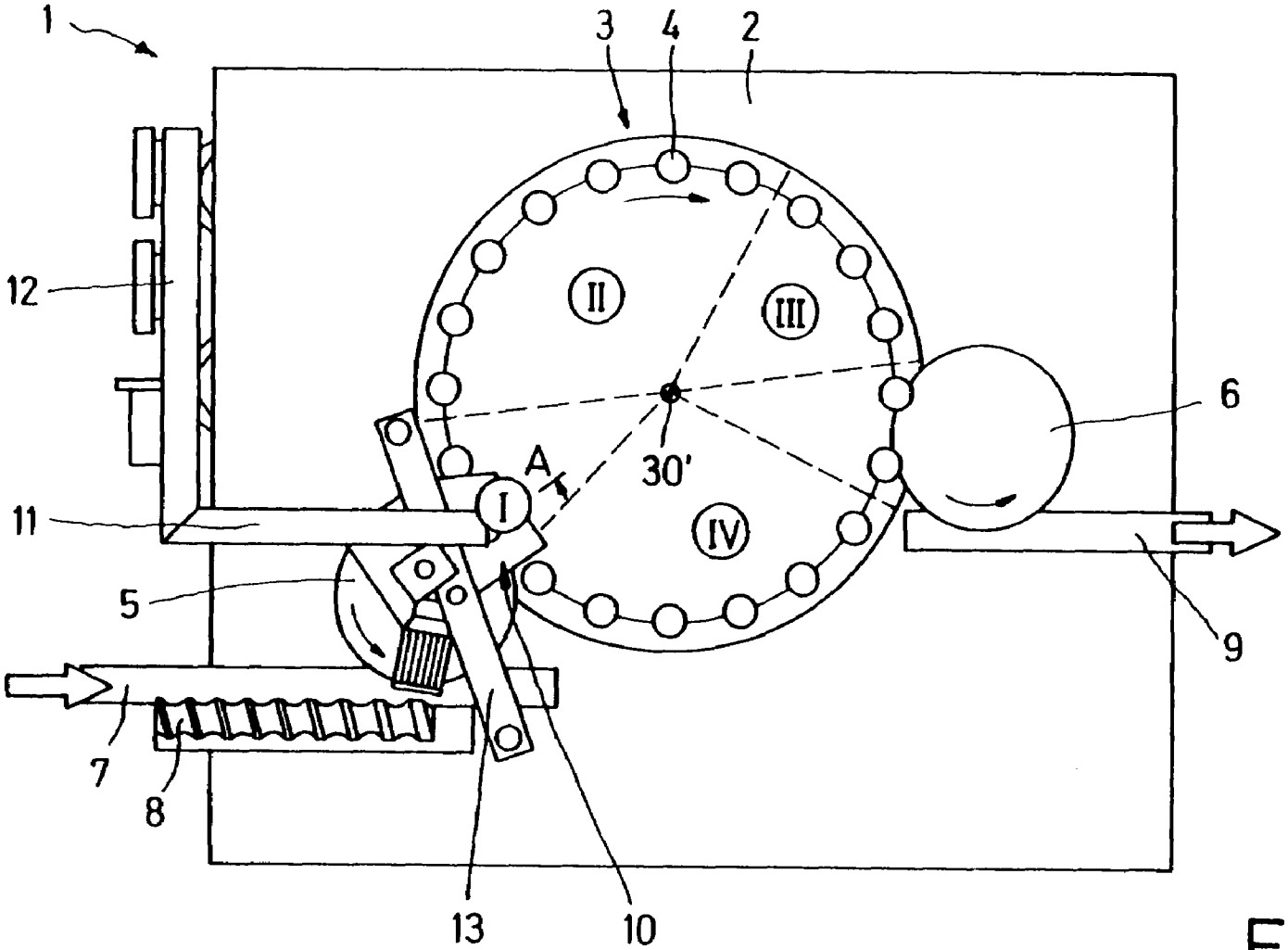
FIG. 1*a* shows a machine with a revolving table for pull-over application of label jackets to bottles in a simplified diagrammatic top view.

The machine 1 shown in FIG. 1*a* essentially consists of a horizontal table top 2, on which a revolving table 3 is rotatably secured with rotation about a vertical axis 3', which revolving table is provided with several bottle dishes 4 arranged at regular intervals on a common sector of the circle. With displacement, a feed star wheel 5, with associated feeding conveyor 7, and a one-piece endless screw 8 and a delivery star wheel 6, with associated removal conveyor 9, are located on the revolving table 3, with circumferential displacement.

Figure 1B:
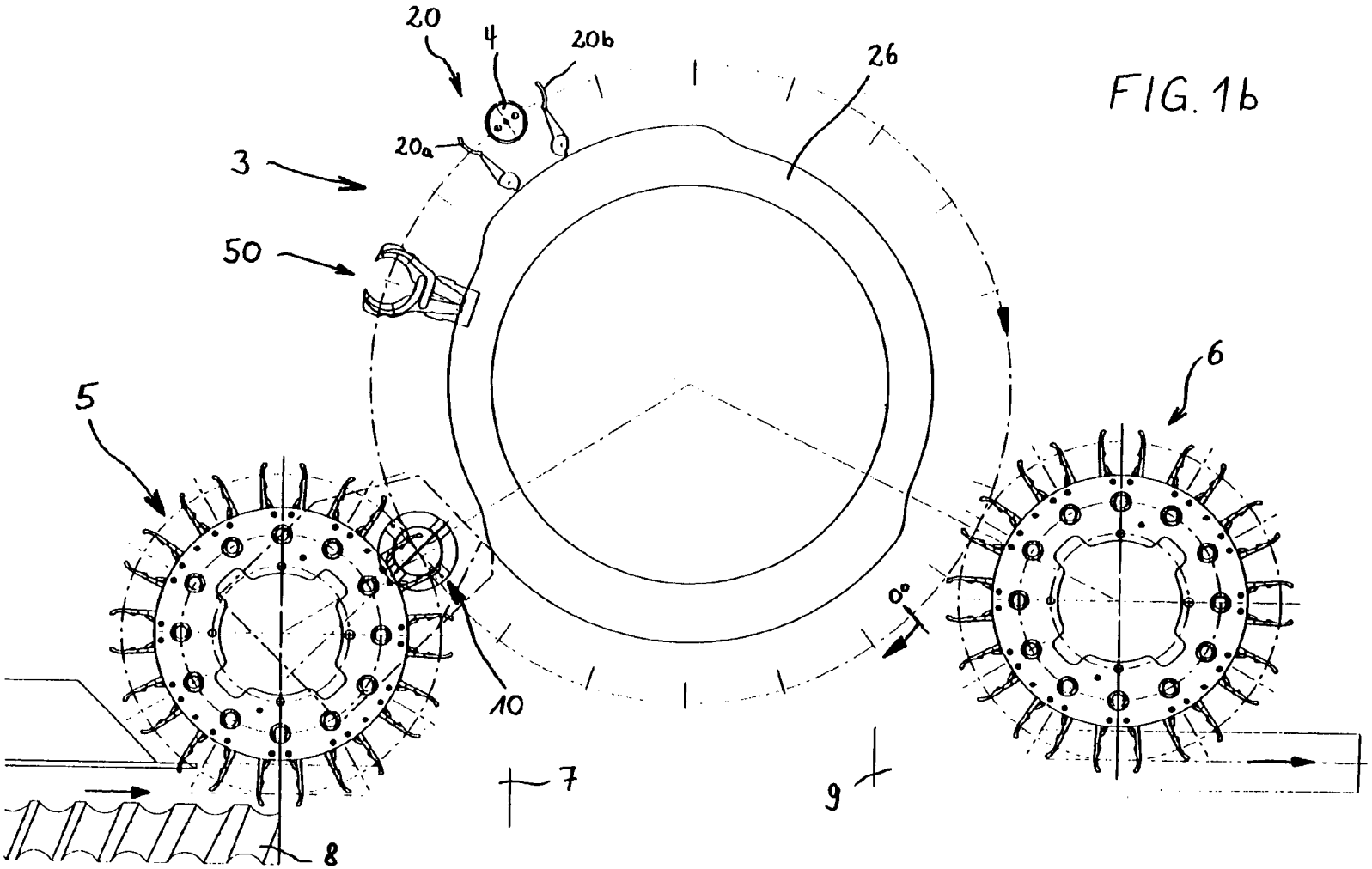
FIG. 1*b* shows a radial cam assigned to the revolving table for the actuation of gripper clamps provided on the revolving table to hold bottles, as well as star wheels to load and unload the bottles in a top view.

Both the feed start wheel 5 and the delivery star wheel 6 are equipped at their periphery with seizing devices to seize and hold bottles at their mantle surface (FIG. 1*b*). These gripping devices, for example, with swivel clamp arms which are in opposite direction in pairs, can be controlled at different places of their circumferential path, from a gripping position into a release position. Such clamp star wheels are described in detail, for example, in U.S. Pat. No. 5,607,045.

Above the common transfer point I between the revolving table 3 and the feed star wheel 5, a cutting block 10 is provided on a cross bar 13, where the cutting block is held in fixed position, for the feeding, unfolding of a film hose and for cutting off label jackets E, where the label film hose 11 is pulled off a hose reservoir 12 which is secured laterally to the machine, and, in the process, it is led to the cutting block 10 over several deflection rollers. The above mentioned cross bar 13 can be adjusted, in its height, for adaptation to different label jacket lengths, advantageously by an electromotor adjustment device, which is not shown in detail. The cutting block 10 can be constructed according to the Published German Patent Application DE 2950785 A1.

The revolving table 3, the star wheels 5 and 6, the conveyors 7 and 9, as well as the one-piece endless screw 8 are driven continuously with synchronous speed and positioning with respect to each other, in a circular movement, by individual motor drives or a common machine drive and drive elements. The cutting block 10 has drive devices to effect, synchronously with respect to the movement of the revolving table, the advance, with exact positioning, of the label jacket hose and the cutting off of label jackets E by the cutting tool of the block 10. Reference is made to the above mentioned German Patent Application concerning the exact construction.

Figure 4:
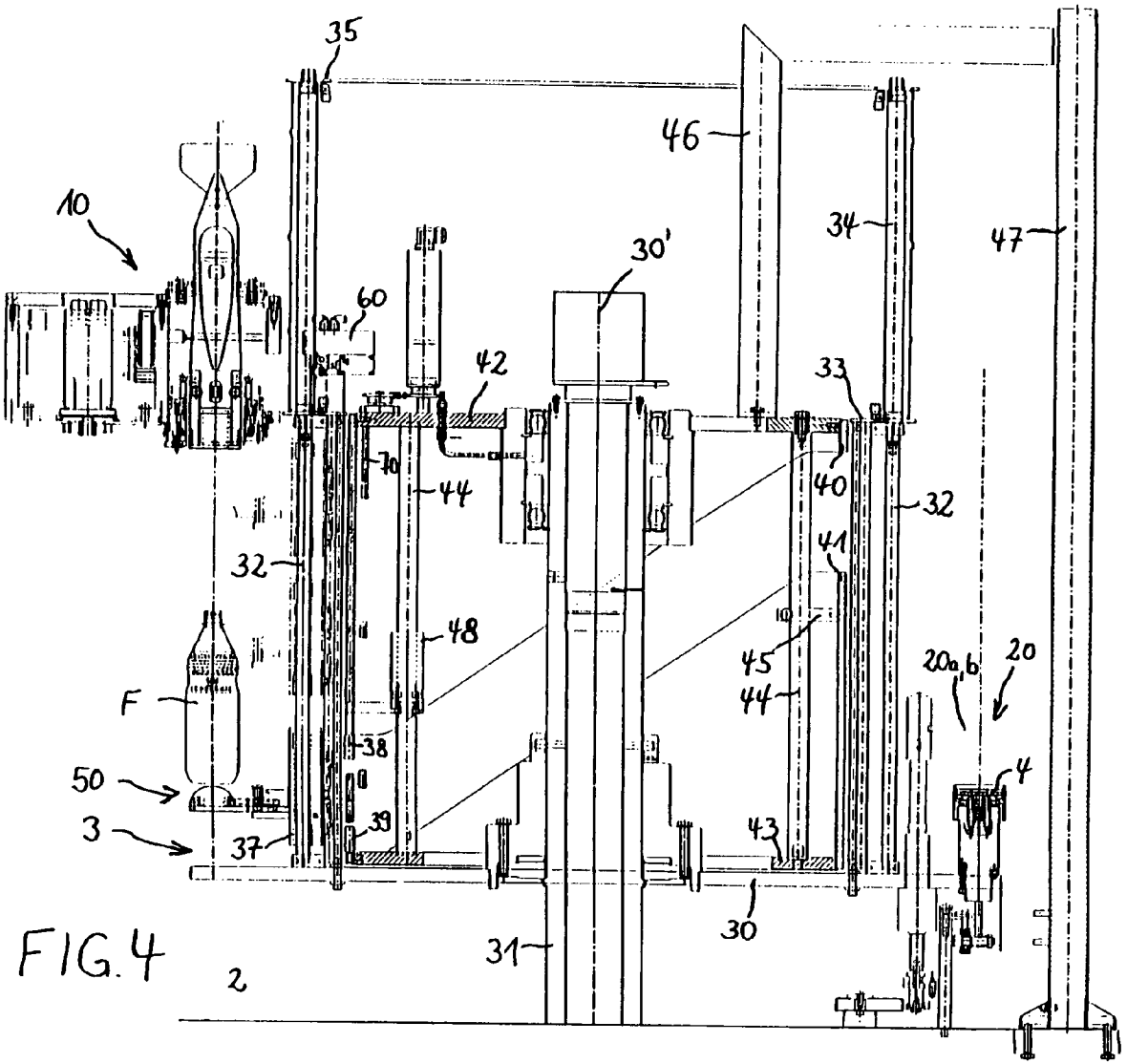
FIG. 4 shows a vertical complete cross section through the revolving table of the machine in FIG. 1.
Figure 5A:
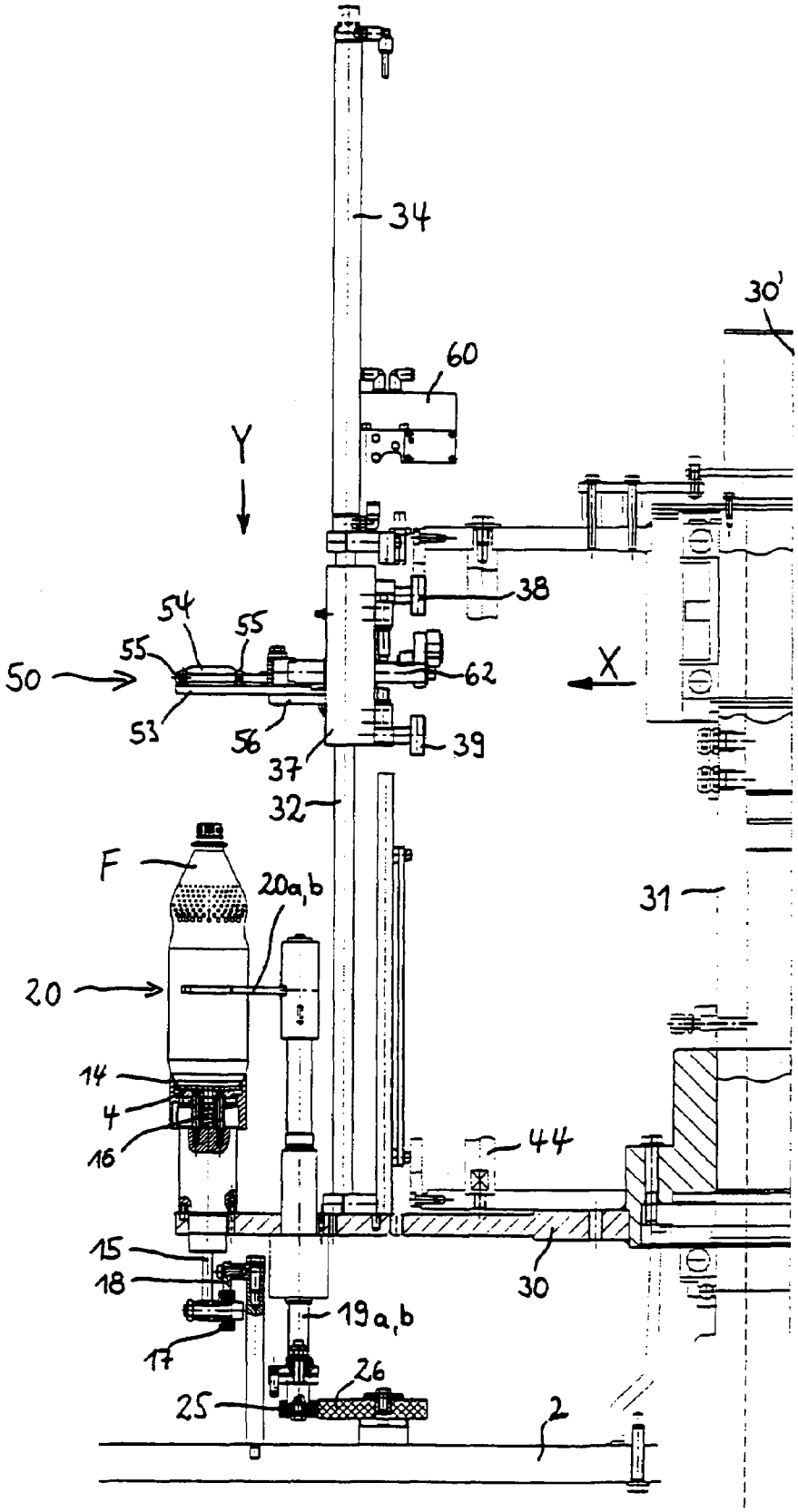
FIG. 5*a* shows a partial cross section of FIG. 4 in an enlarged representation.

The construction of the revolving table 3 is explained in greater detail below with reference to the vertical cross sectional representation shown in FIGS. 4 and 5*a*. The base of the revolving table 3 is formed by a horizontal support disk 30, which is secured, so as not to allow rotation, at its center to a vertical main shaft 31, and which bears, on its top side, the bottle dish 4 (not shown in the left half of FIG. 4). Each bottle dish 4 is associated with a pair of parallel guide rods 32 in a vertical position on the top side of the carrier disk 30, which pair is located radially inside the imaginary sector of a circle, on which the bottle dishes 4 are arranged. The ends of the guide rods 32 which are turned away from the carrier disk 30, and turned upward, bear a ring disk 33, whose middle is empty, and which is arranged parallel to the support disk 30, on which ring disk several double-action pneumatic cylinders 34 are secured in a vertical upright position, in each case in the middle between a pair of guide rods 32, with associated control valves 60. To guarantee a stable hold of the cylinders 34, the vertical upward housing ends of these cylinders are connected by a second ring disk 35, which also has an empty middle. The piston rod 36 of the double-action pneumatic cylinders 34 can be moved out, vertically and in parallel, between a pair of guide rods 32 where, in the first ring disk 33, a hole is present in each case in a position in the middle between the guide rods 32, to allow the free penetration of the piston rods 36.

Figure 6:
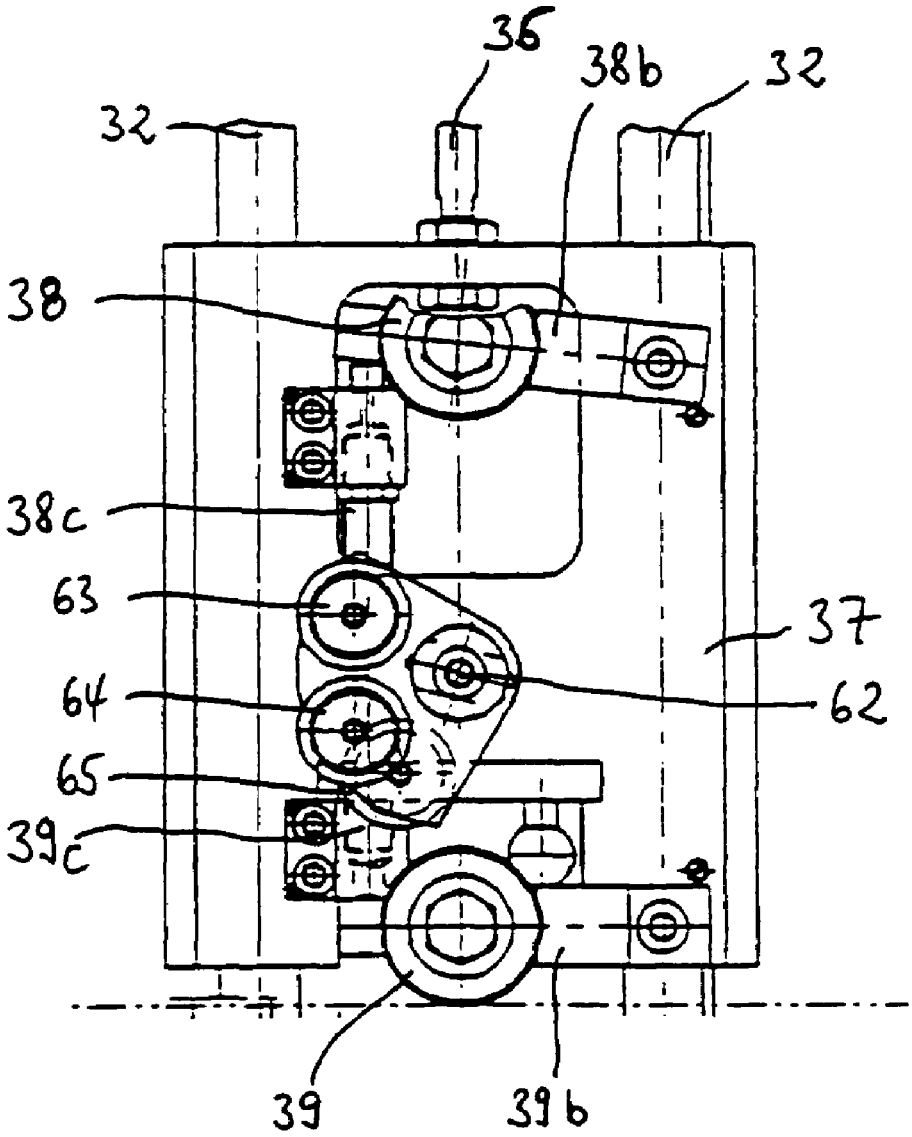
FIG. 6 shows a side view of a separating jaw unit in the viewing direction X in FIG. 5*a*.

The downward pointing end of the piston rod 36 is secured to slide block 37 which preferably has two parallel bore holes, each of which is penetrated by a guide rod 32, which slide block, on its backside turned toward the main shaft 31, presents an upper and lower guide roller 38 or 39. The guide rollers 38 and 39 are, in each case, rotatably secured to swiveling levers 38*b* and 39*b* (FIG. 6), which in turn are secured to slide blocks 37. In the swiveling range of these levers, shock absorbers 38*c* and 39*c*, respectively, with terminal abutments are attached to the slide block.

The top guide roller 38 is applied against the control surface of an upper, cylindrically bent, radial cam 40, which is attached to the circumference of a horizontal disk 42. This disk 42 has a pipe-like attachment, which is secured with pivot bearings to the top end of the main shaft 31. At the bottom side of the disk 42, there are several separator bolts 44, which hang downward, and which are displaced at regular intervals over the circumference. At the lower ends of the separator bolts, a circular disk 43, with empty middle, is attached, which carries at its circumference a bottom radial cam 41 for the other guide rollers 39, with central attachment. In addition, the bottom radial cam 41 is held in a position so it cannot rotate by a clamp piece 45 provided on the separator bolts 44. The bottom radial cam 41, which is also cylindrically shaped, has a control surface pointed upward, on which the guide rollers 39 move.

Figure 8:
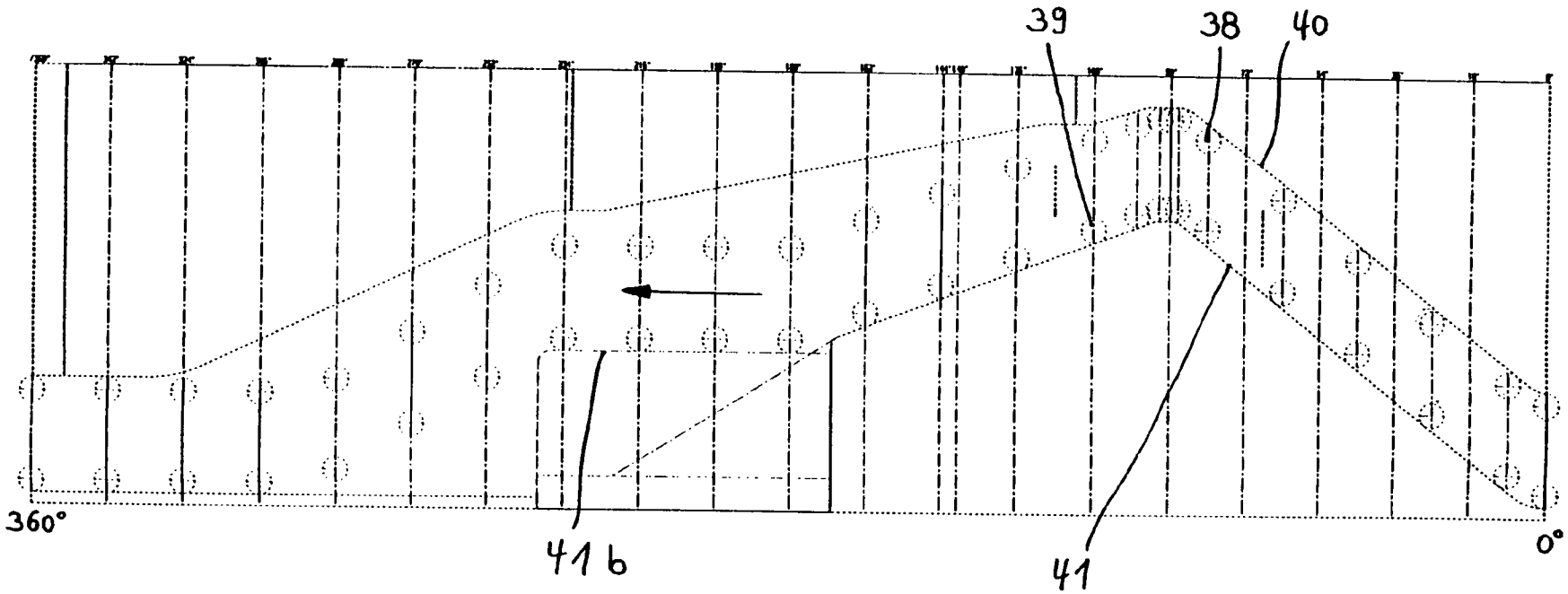
FIG. 8 shows the development view of the radial cams for the movement in height of the separation jaw units.

The course of the curves of the two radial cams 40 and 41 can be seen in detail in the development view represented in FIG. 8, where the running direction of the guide rollers 38, 39 is directed, starting from the 0 degree mark (see also FIG. 1*b*), in the direction of the arrow from the right to the left. In order to be able to use the machine 1 to process different bottle types and/or jacket labels E, where the adhesion height, that is the lower margin of the label jacket with reference to the bottom of the bottle, can be different, the lower radial cam 41 has a curve section 41*b* (see FIG. 8) whose height can be adjusted continuously, and whose control surface determines the adhesion height of the label jacket E on the bottles F. This curve section 41*b* is connected in each case with two slide bushes 48 which are led in a manner so they can slide on two separated separator bolts 44 and which can be lifted or lowered, continuously, by means of a threaded spindle which is not shown (FIG. 4).

In order to prevent the radial cams 40 and 41 from also turning, an angular torque support 46 is attached to the top side of the disk 42, which support is braced by a stationary column 47 arranged; outside of the revolving table 3, vertically on the table top 2.

The bottom dishes 4 which are arranged on a common circle sector of the support disk 30 at a fixed height, and which in each case are surrounded by a centering ring 14 secured by a spring method, whose coaxial height can be moved, and which presents a margin which surrounds and holds the bottle dish 4, and extends above it, and which is adapted to the contour of the bottom of the bottle. This centering ring 14 is coupled with a rod 15 which is led in a manner so it can be shifted in the support disk 30, which projects with its lower end over the bottom side of the support disk 30 and supports a guide roller 17 (FIG. 5*a*). Below the support disk 30, at the circumferential path of the guide rollers 17, a radial cam 18 is attached in a manner so it cannot be turned on the table top 2, which, in the circumferential area from the delivery star wheel 6 to the feed star wheel 5 effects a lowering of the guide rollers 17 against the return force of a coil spring 16 with permanent vertical upward action. In this process, the upper margin of the centering ring 14 is held, during the feeding and delivery of the bottles F on the bottle dishes 4, under the top side of the bottle dishes (FIG. 2*c*).

Figure 9:
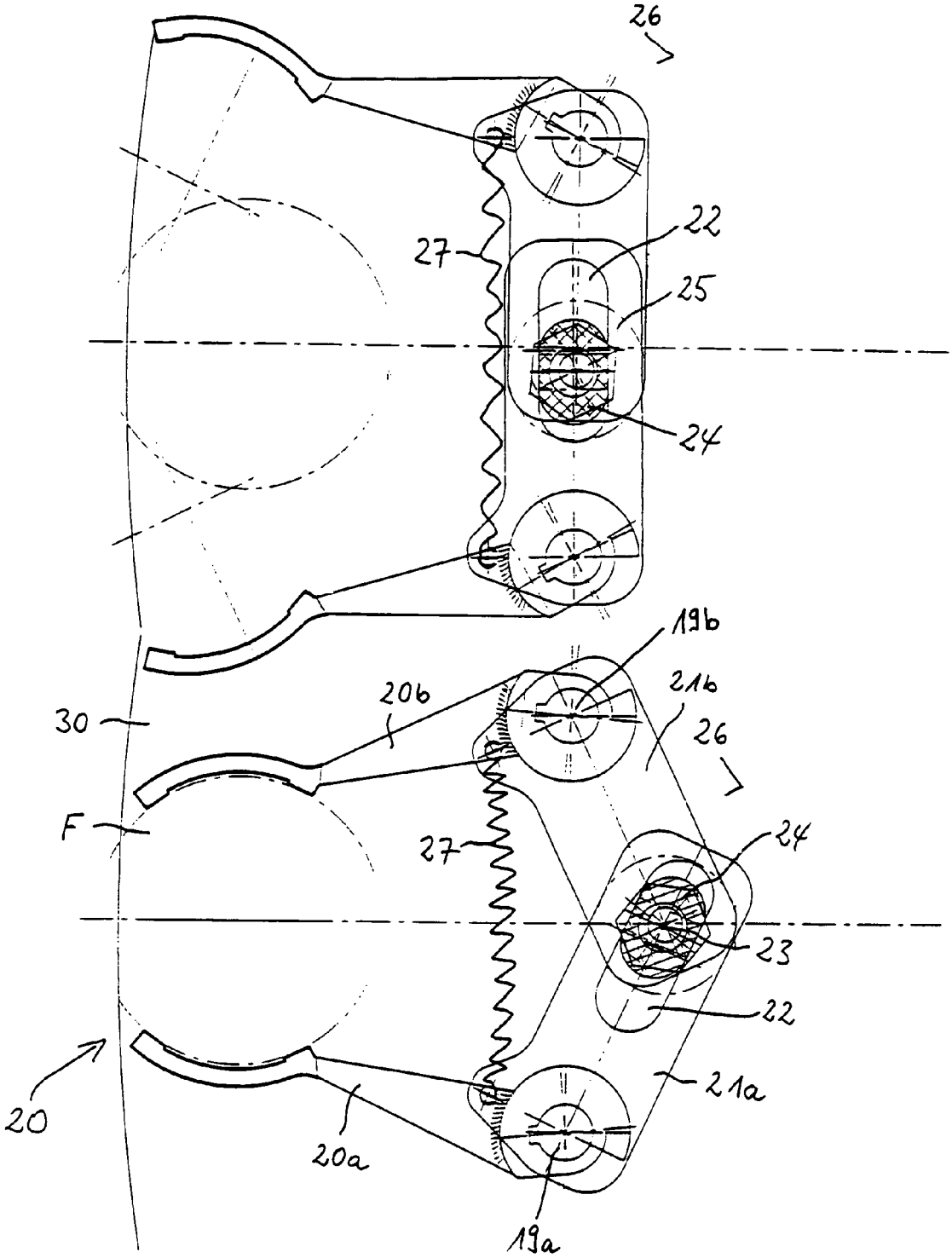
FIG. 9 shows a top view of a bottle seizing unit at the revolving table of the machine according to FIG. 1*b* in two different positions.

In addition, each bottle dish 4 is associated with two shafts 19*a*, 19*b*, which are arranged at an interval, parallel and vertically with respect to each other, with rotatable securing in the carrier disk 30. Each of these shafts supports at its top end a horizontal grip arm 20*a* and 20*b*, respectively, which extends outward and which is secured in a manner so it can not be turned, which arms together form controllable grip pincers 20 for seizing and holding a bottle F to be labeled on a bottle dish 4 (FIG. 9). At the lower end of the shaft 19*a*, a lever 21*a* fitted with a elongate hole 22 is attached, and at the lower end of the shaft 19*b*, a lever 21*b* equipped with a vertical bearing bolt 23 is attached, in a manner so they can not turn. The bearing bolt carries a sliding block 24 which can be swiveled and which penetrates into the elongate hole 22, and a guide roller 25 with displaced height, which roll is applied to the radial external control surface of a curve ring 26 which is maintained on the table top 2 in a manner so it can not turn. At the two levers 21*a*, 21*b*, a tension spring 27 is applied, which is permanently active in the direction of a closing movement of the gripper clamp 20. The form of the curve ring 26 which has two cam sections which project radially outward can be seen in FIG. 1*b*. When passing this section, the guide roller 25 is pressed outward, where the grip arms 20*a*, 20*b* swivel outward in opposite directions. The different positions of a gripper clamp 20 can be seen in FIG. 9. Holding of the bottle can occur at two places of its mantle surface with separation intervals in the axial direction, and alternately controlling the two axially displaced holding devices to rise, during the pull-over application of the label jacket, in such a manner that the object is at all times subject to or guided by at least one holding device.

Figure 7:
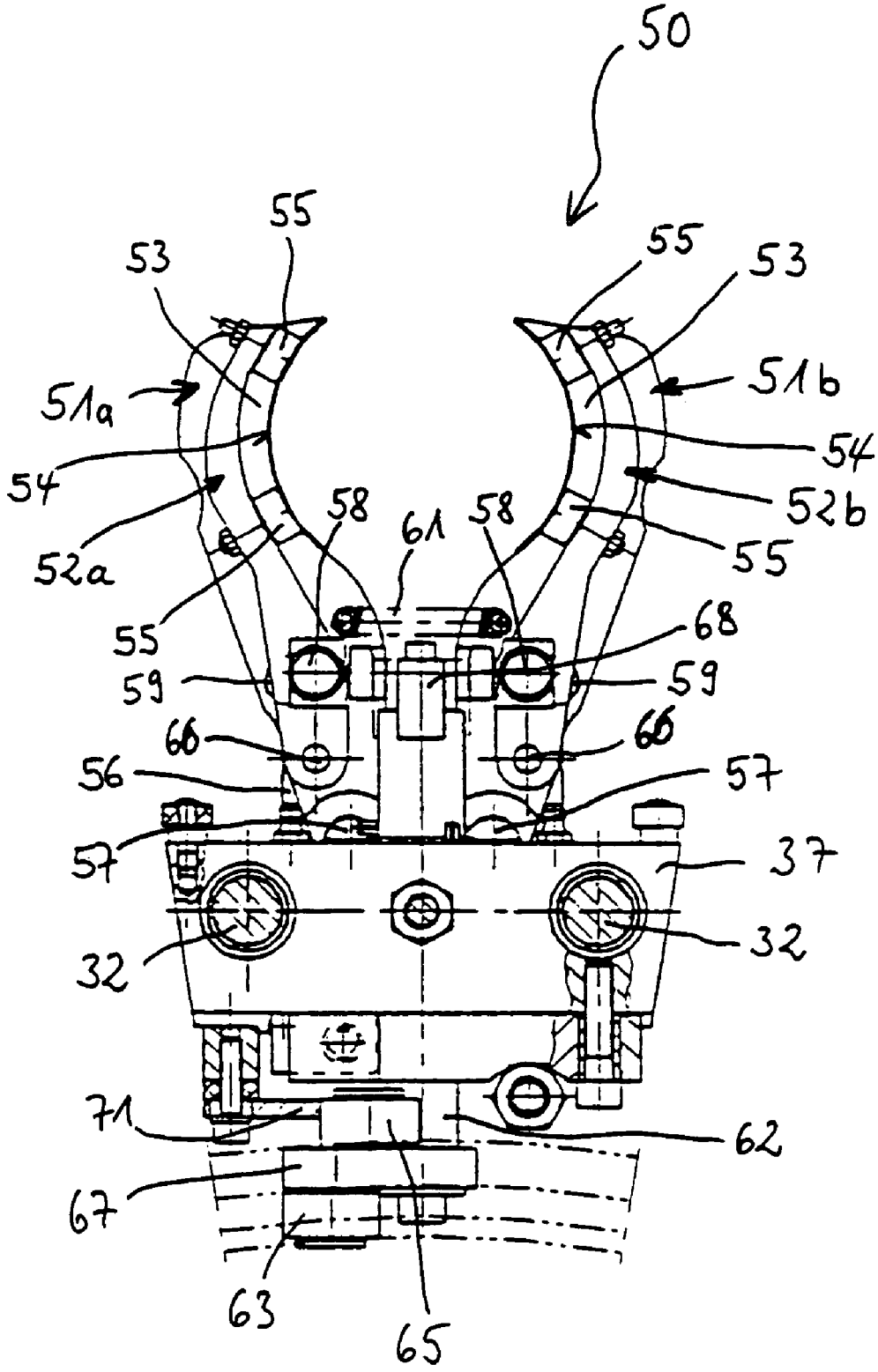
FIG. 7 shows a top view of a separation jaw unit in the viewing direction Y in FIG. 5*a*.

FIG. 7 shows the construction of a spreading jaw unit 50 for the friction-positive seizing and pulling over of a label jacket E on the trunk of a bottle F, for example, a PET bottle. It consists of two internal jaws 51*a*, 51*b* and the counter arms 52*a*, 52*b* associated with them. The internal jaws each have a horizontal application surface 53 for the lower margin of a label jacket and a half-shell 54 which is bent upward, and whose curvature is adapted to the bottle diameter. The following half-shell, in the direction of rotation of the revolving table 3, can have a lower height than the preceding half-shell. The counter arms, which are also curved, each carry two elastic rubber resilient pads 55 which can be applied radially from the outside to the half-shell, and which can be regulated to achieve a uniform seizing of a label jacket. On a support plate 56 which is inserted horizontally and can be quickly exchanged on the slide block 37, two vertical bearing bolts 57 for the internal jaws and two additional vertical bearing bolts 58 for the counter arms are attached, where the bearing bolts 58 freely penetrate two curved elongate holes 59 in the internal jaws. In each case, a hinge 66 is used to couple the counter arms with their corresponding internal jaw, in such a manner that the swiveling of the internal jaws toward each other results in the swiveling of the counter arms away from each other, and vice versa. Close to the half-shells, one of these attracting tension springs 61 engages with the internal jaw. Approximately in the middle between the bearing bolts 58, a control cam 68 which can not be turned is located on a shaft 62 is secured horizontally in the slide block 37, where the height of the control cam is between the internal jaws. At the opposite end of the same shaft, a control segment 67 which presents a total of three guide rollers 63, 64, 65, is secured in a manner so it can not turn. With the two guide rollers 63, 64 which are arranged on the side of the control segment turned away from the slide block, the symmetrically shaped control cam can, as desired, be adjusted by rotation in the clockwise direction or in the opposite direction by approximately 90° by means of curve section 70 arranged at the circumferential path, while the third guide roller 65, located on the opposite side of the control segment, is used to maintain the label holding position of the spreading jaw unit 50, while its downward movement is used for the pull-over application on a bottle. For this purpose, this guide roller 65 is associated with a vertical longitudinal guidance strip 71, which rotates with the revolving table 3, and where the guide roller runs along this guidance strip during the lowering.

In contrast to the above described embodiment, the counter arms, if appropriately shaped—as shown in FIG. 1*b*—can each be secured with one end rigidly to the diametrically opposite internal jaw.

The course of the operation during the passage of a bottle through the machine is described below, essentially with reference to FIG. 1*a:*

A bottle F which arrives on the conveyor 7 is seized by the one-piece endless screw 8, introduced in an appropriate position into the feed star wheel 5, seized by the latter's controlled clamps and positioned at the common contact point I on a bottle dish 4 of the revolving table 3, where, at the same time, the centering ring 14 is led upward and the associated gripper clamp 20 is closed. The corresponding clamp of the feed star wheel instantaneously releases the bottle.

Figure 5B:
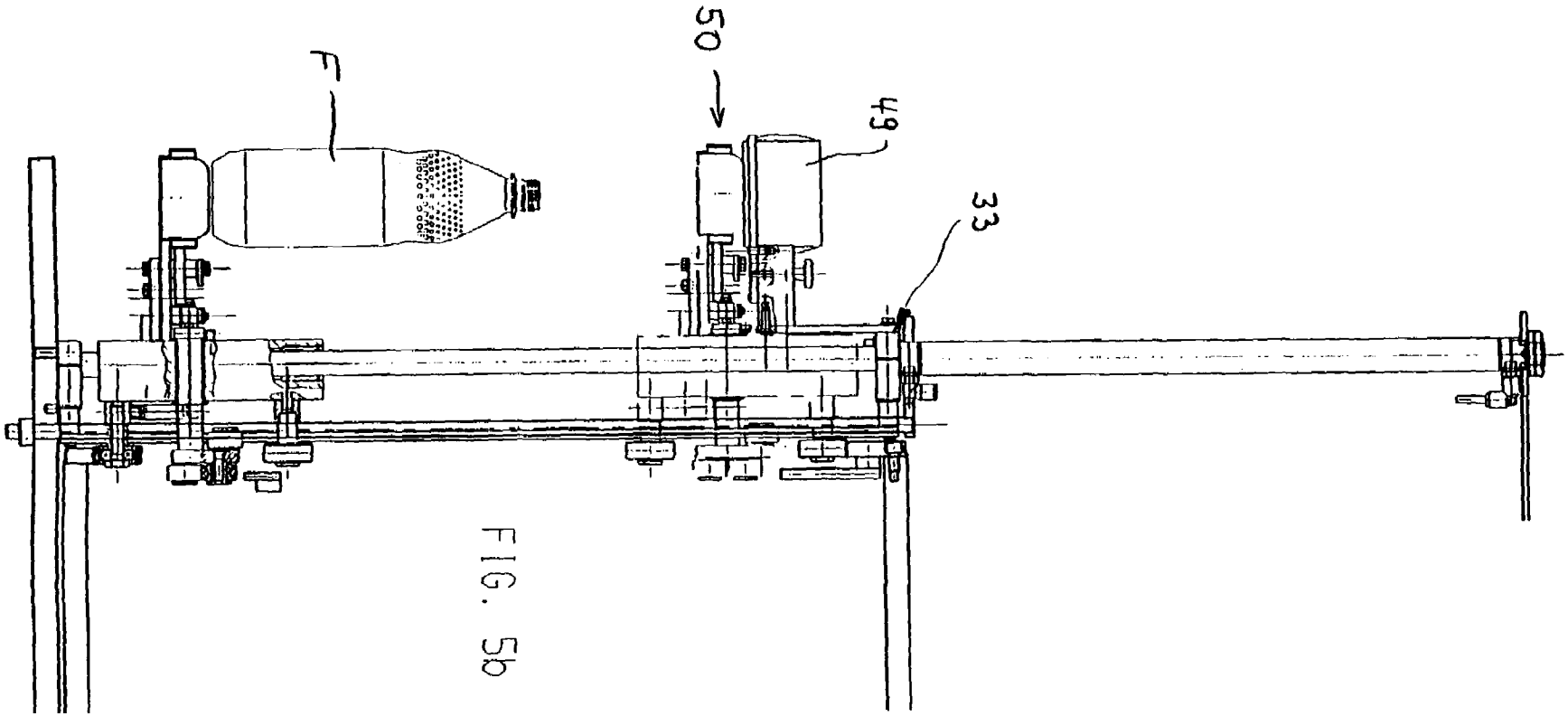
FIG. 5*b* shows a partial cross section corresponding to FIG. 5*a* with an additional label jacket support.
Figure 5C:
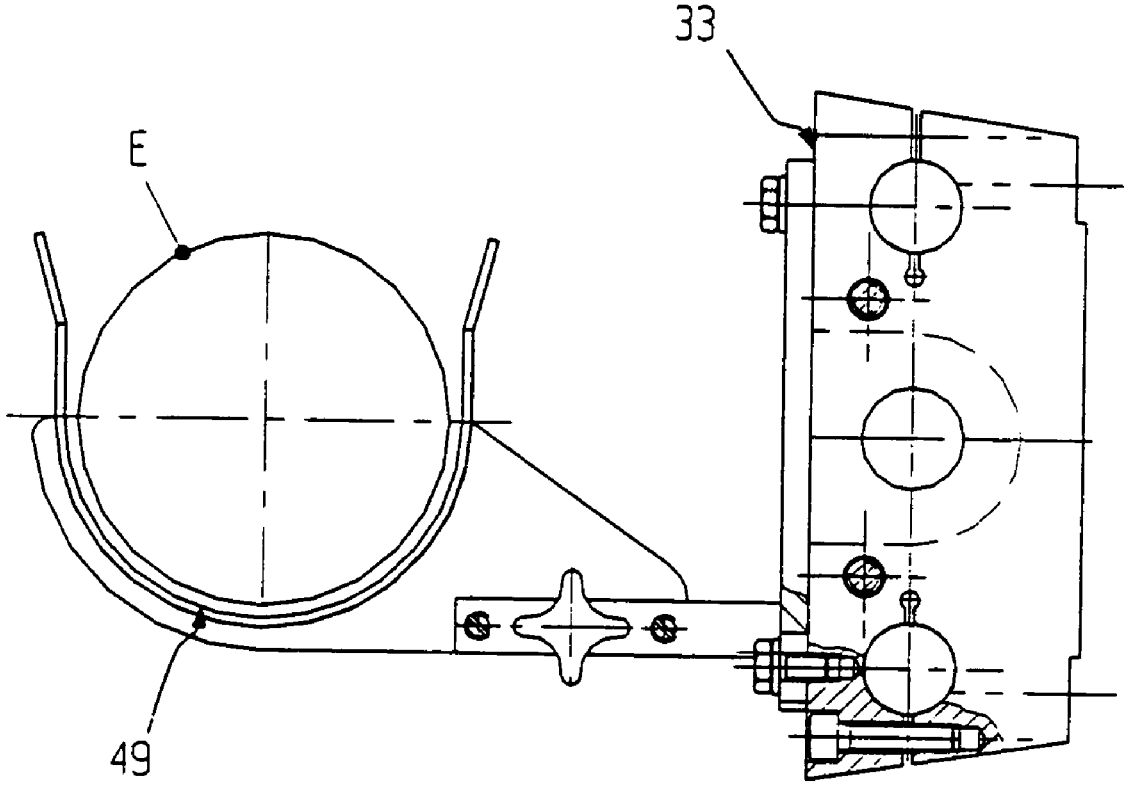
FIG. 5*c* shows a top view of a label jacket support of FIG. 5*b*.

At the same time, a spreading jaw unit 50 which is associated with the bottle approaches the cutting block 10 as a result of its upward movement, where the half-shells 54 and the rubber resilient pad 55 are separated from each other at this time. At the same time, the label hose 11 is advanced from above downward, and a label jacket E is cut off, which is then located, with its lower margin, on the application surface 53 of the internal jaws 51*a*, 51*b*, that is the half-shells are located within the label jacket and the rubber resilient pad outside. In order to prevent the tipping of the label jacket at the time of the uptake and acceleration in the direction of rotation of the revolving table 3, a concave curved support shell 49 is located at the height of the label jacket E which has just been separated from the hose, which shell moves in the same direction as the revolving table—seen in the direction of rotation—and is applied to the back side of the label, where the support shell 49 is secured with fixed height at the radial external margin of the ring disk 33 by means of a bracket (FIG. 5*b*). FIG. 5*c* shows the shape of the support shell 49 in a top view.

Immediately thereafter, the shaft 62 with its control cam 68 is rotated in such a manner that the half-shells 54 are swiveled away from each other and at the same time the rubber resilient pads 55 are swiveled inward and in opposite directions, until the label jacket is clamped at its lower margin, outside and inside, with friction lock. In the case of a stretchable jacket, the latter is expanded in the process to an extent which is larger than the diameter of the bottle.

When passing through sector II (FIG. 1*a*), the label jacket is pulled, by the separation jaw unit 50 which is pressed downward by the pneumatic cylinder 34, from top to bottom over a bottle F. As soon as the spreading jaw unit, during the lowering movement, approaches the gripper clamp 20 which holds the bottle, the gripper clamp is opened for a short time, long enough so that the spreading jaws are able to pass through the gripper clamp (second half in sector II). Later, the gripper clamp 20 can again be closed, to such an extent that the bottle is led by its circumference, but a sufficient slit remains to continue pulling through the label jacket. As soon as the label jacket has reached the intended adhesion height, the lifting movement of the spreading jaws is stopped, the gripper clamp 20 is completely closed (label pressed against the bottle trunk) and the half-shells 54 are swiveled slightly inward (the clamping of the lower label margin is released). These processes occur in sector III.

Even before the delivery star wheel 6 is reached, the spreading jaw unit 50 is now again lowered, until the half-shells are located completely under the bottle dishes 4 (FIG. 2*c*). In the case of a shrink wrap jacket, "which has an internal diameter equal to or larger than the external diameter of the bottle," the preliminary shrinking (hot air, etc.) for affixing the label can now occur at the revolving table 3. In addition, the centering ring 14 is lowered now, and the gripper clamp 20 is opened, when the delivery star wheel 6 has seized the bottle for transfer to the conveyor 9.

Then, the pneumatic cylinder 34 is adjusted for lifting, so that the spreading jaw unit 50 again reaches its original upper position before passing the feed star wheel 5 (sector IV).

During the entire treatment process, the bottles are transported without change in height position through the machine.

Figure 10:
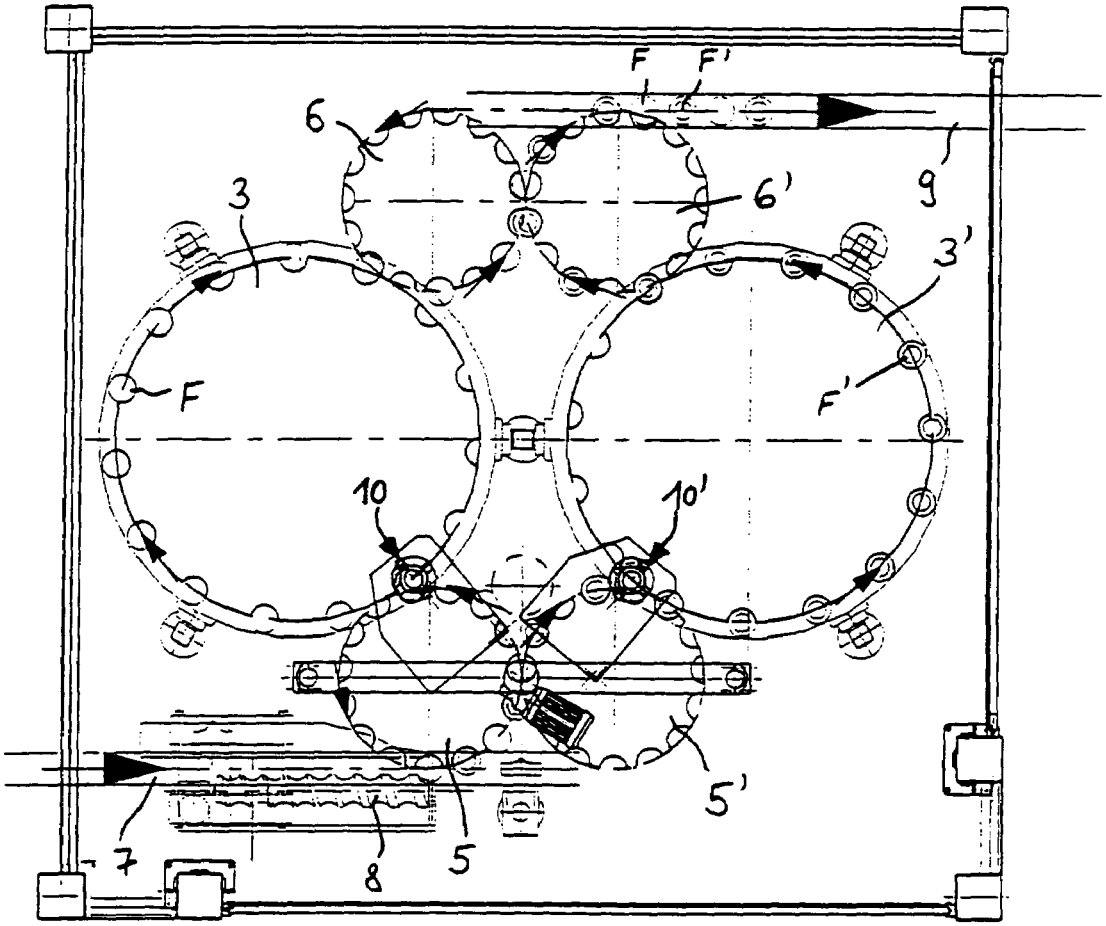
FIG. 10 shows a variation of the machine according to FIG. 1 with two revolving tables in a diagrammatic top view.

FIG. 10 represents a machine variant for high outputs, which is formed by a mirrored arrangement of two individual machines according to FIG. 1*a* or 1*b*, that is this double machine has two feed star wheels 5 and 5', two carousels or revolving tables 3 and 3', as well as two delivery star wheels 6 and 6', but only one common conveyor 7, one removing conveyor 9 and the one-piece endless screw 8. The star wheels 5, 5' or 6, 6', respectively, which are opposite each other and which can be driven in opposite directions to each other, in each case contact the sector of a circle of their counter part and they are equipped, at the circumference, with controllable clamps—according to the representation in FIG. 1*b*—which can be adjusted selectively from a seize position for seizing a bottle into a release position, and vice versa, by means of switch cams, not shown, which are arranged in a fixed position at certain places of their circumferential path. This partition measure, that is the interval between two adjacent bottle dishes 4 on the two revolving tables 3 and 3', is twice that of the partition measure of the feed and delivery star wheels 5, 5' and 6, 6'. All the bottles which are supplied continuously in a single track by the feed conveyor 7 are pulled apart by the one-piece endless screw 8 to the partition measure of the feed star wheel 5 and seized by the latter. At the common contact point of the two feed star wheels 5 and 5' each second bottle F is released by the first feed star wheel 5 and simultaneously seized by the second feed star wheel 5'. In this manner, the bottles F and F' are alternately led to the two revolving tables 3 and 3'. Each revolving table is associated in the transfer area of its feed star wheel with a cutting block 10 or 10' for the separation of label jackets E from a label film hose. On the side of the delivery, the finished, labeled, bottles F and F', which arrive alternately from the two revolving tables 3 and 3' at the common contact point of the two delivery star wheels 6 and 6', are again combined to one row and they are transferred from the delivery star wheel 6' to the removal conveyor 9. As a result of this modular construction, a larger range of outputs can be covered than with only two variants. It is understood that, instead of clamp star wheels, it is also possible to use alternate solutions with differently designed holding devices for the selective seizing of the bottles, such as, for example, vacuum star wheels or similar transport installations.

We claim:

1. A process for attaching a label jacket to objects, such as bottles or similar items, comprising:

seizing a label jacket by a separating jaw unit by its forward margin for pulling in an axial direction over an object, holding the object with a holding device, prior to the pull-over application by the area of its mantle surface, by positive or friction lock, initiating the pull-over process, temporarily releasing the holding device on the mantle surface as soon as the separating jaw unit at least partially surrounds the object over its mantle surface, seizing the latter object by the area of its mantle surface, which is now covered with the label, at the latest when the desired adhesion height of the label jacket on the object has been reached, and thereby affixing the label in a manner so it cannot slip, pulling off the separating jaw unit, and causing the hold of the object to occur at two places of its mantle surface with separation intervals in the axial direction, and alternately controlling the two axially displaced holding devices to rise, during the pull-over application of the label jacket, in such a manner that the object is at all times subject to or guided by at least one holding device.

2. Process according to claim 1, and causing the hold on the mantle surface of the object to occur at a certain height position, first with positive or friction lock, briefly releasing the holding device as soon as the forward margin of the label jacket approaches this height position with simultaneous axial support of the object, and holding the object, after the passage of the height position, in such a manner that the label jacket can then continue to be pulled over axially with respect to the object until the adhesion height is reached.

3. Process according to claim 1, and controlling the holding device of the object, during the axial pull-over application of the label jacket, as a function of the operating movement of the spreading jaw unit.

4. Process according to claim 1, wherein the label jacket comprises a stretchable film hose material with smaller internal diameter than the external diameter of the object, and the further steps of, before the pulling over, elastically extending the stretchable film hose material at least at its forward margin advancing in the axial direction, by the spreading jaw to a value in excess of the external diameter, and releasing the elastic extension of the stretchable film hose material after the adhesion height has been reached.

5. Process according to claim 1, wherein the label jacket comprises a film hose material which is shrinkable when exposed to heat, which has an internal diameter which is equal to or larger than the external diameter of the object, and the further step of, after the adhesion height has been reached, at least partially shrink wrapping the film hose material on the object, before the holding device of the label jacket and of the object is released.

6. Process according to claim 5, wherein, after releasing the holding device, a complete shrink wrapping occurs.

7. Process according to claim 1, and continuously transporting the object, at least during the pull-over application of the label jacket.

8. Process according to claim 1, wherein the object is continuously transported in a circular path.

9. A process for attaching a label jacket to objects, such as bottles or similar items, comprising:

seizing a label jacket by a separating jaw unit by its forward margin for pulling in an axial direction over an object, holding the object with a holding device, prior to the pull-over application by the area of its mantle surface, by positive or friction lock, initiating the pull-over process, temporarily releasing the holding device on the mantle surface as soon as the separating jaw unit at least partially surrounds the object over its mantle surface, seizing the latter object by the area of its mantle surface, which is now covered with the label, at the latest when the desired adhesion height of the label jacket on the object has been reached, and thereby affixing the label in a manner so it cannot slip, pulling off the separating jaw unit, wherein the label jacket consists of a film hose material which is shrinkable when exposed to heat, which has an internal diameter which is equal to or larger than the external diameter of the object, and the further step of, after the adhesion height has been reached, at least partially shrink wrapping the film hose material on the object, before the holding device of the label jacket and of the object is released.

10. Process according to claim 9, and causing the hold on the mantle surface of the object to occur at a certain height position, first with positive or friction lock, briefly releasing the holding device as soon as the forward margin of the label jacket approaches this height position with simultaneous axial support of the object, and holding the object, after the passage of the height position, in such a manner that the label jacket can then continue to be pulled over axially with respect to the object until the adhesion height is reached.

11. Process according to claim 9, and causing the hold of the object to occur at two places of its mantle surface with separation intervals in the axial direction, and alternately controlling the two axially displaced holding devices to rise, during the pull-over application of the label jacket, in such a manner that the object is at all times subject to or guided by at least one holding device.

12. Process according to claim 9, and controlling the holding device of the object, during the axial pull-over application of the label jacket, as a function of the operating movement of the spreading jaw unit.

13. Process according to claim 9, wherein, after releasing the holding device, a complete shrink wrapping occurs.

14. Process according to claim 9, and continuously transporting the object, at least during the pull-over application of the label jacket.

15. Process according to claim 9, wherein the object is continuously transported in a circular path.

16. Device for the attachment of a label jacket (E) to objects (F), such as bottles or similar items, comprising in combination:

at least one spreading jaw unit (50) for seizing the label jacket at is forward margin and axial pull-over application of the label jacket by means of the spreading jaw unit onto an object, at least one controllable holding device (20) for seizing the object (F), with positive or friction lock, in the area of its mantle surface, wherein said spreading jaw unit (50) is constructed in the form of a nipper having two internal jaws (51*a*, 51*b*), which can be swiveled horizontally in opposite directions in a controlled manner and an application surface (53) for the forward margin of a label jacket (E), and two counter arms (52*a*, 52*b*), which are associated with said internal jaws and which can be swiveled in opposite directions either towards each other or towards said internal jaws, and where said internal jaws can be brought in contact with friction lock with the internal side, and said counter arms with the external side, of a label jacket.

17. Device according to claim 16, wherein said at least one spreading jaw unit (50) and said at least one holding device (20) are associated with a continuously drivable conveyor (3) for transporting the object (F).

18. Device according to claim 17, wherein said at least one spreading jaw unit (50) and said at least one holding device (20) are moved synchronously with said object (F) by said drivable conveyor (3).

19. Device according to claim 16, wherein said holding device (20) seizes, after the pull-over application of the label jacket (E), the area of the mantle surface of the object (F) that has been covered.

20. Device according to claim 19, wherein the holding device (20) seizes said mantle surface area in the middle section of the object (F) having the largest external diameter.

21. Device according to claim 16, wherein said holding device (20) is constructed in the form of a clamp having two arms (20*a*, 20*b*) which can be moved in opposite directions.

22. Device according to claim 21, wherein said arms (20*a*, 20*b*) are appropriately adapted in their shape to the external contour of the object (F), matching the area that is seized.

23. Device according to claim 22, wherein said arms have a non-slip surface.

24. Device according to claim 21, wherein said clamp (20) is associated, as a function of the direction of movement of the spreading jaw unit (50), with the controllable actuation device (21–26).

25. Device according to claim 24, wherein said clamp (20) can be moved from a release position to a seize position, and vice versa.

26. Device according to claim 25, wherein said actuation device (21–26) is constructed to have two different seize positions, where, in a first seize position between the object (F) and the clamp (20), a slit remains for pulling the label jacket (E) through, and in the second seize position, said clamp (20) is applied, without tolerance, with a defined force of application, to the object (F) or the label jacket (E).

27. Device according to claim 25, wherein in the seize position said clamp is automatically controlled, and in the release position said clamp is controlled by said actuation device (21–26).

28. Device according to claim 21, wherein each said arm (20*a*, 20*b*) of said clamp (20) is secured to its own shaft (19*a*, 19*b*), which is vertical with respect to the plane of transport, and these said shafts (19*a*, 19*b*) are separated from each other by an interval, which allows the free penetration of said spreading jaw unit (50).

29. Device according to claim 28, wherein said spreading jaw unit (50) is secured vertically with respect to the plane of transport of the objects (F), in such manner that said spreading jaw unit can be moved alternately in opposite directions by means of a reversible double-action cylinder (34), and the operating movements are controlled, at least during some periods, by at least one radial cam (40, 41, 41*b*).

30. Device according to claim 28, wherein said at least one spreading jaw unit (50) and said at least one holding device (20) are associated with a continuously drivable conveyor (3) for transporting the object (F), wherein said conveyor (3) is a carousel-like revolving table, which can be rotated about a vertical axis (30'), with several placement surfaces (4), which are evenly separated, for the objects (F), and each said placement surface is associated with a liftable and lowerable said spreading jaw unit (50) and a said clamp (20), where a vertical guide (32), which takes up said spreading jaw unit (50), and said arms (20*a*, 20*b*) of said clamp (20) bearing shafts (19*a*, 19*b*) are arranged on the radially internal side of the circumferential path of said placement surfaces (4).

31. Device according to claim 30, wherein said placement surfaces (4) are associated with controlled liftable and lowerable centering elements (14).

32. Device according to claim 31, wherein said liftable and lowerable centering elements are ring members.

33. Device according to claim 30, wherein said revolving table (3) is associated with a feed star wheel (5) and a delivery star wheel (6) with controllable grip elements to feed and deliver the objects (F), and said spreading jaw units (50) are raised, in the circumferential area from said delivery star wheel to said feed star wheel, from a bottom dead center position into the direction of a top dead center position.

34. Device according to claim 30, further comprising a second revolving table (3'), wherein the two said revolving tables (3, 3') are connected in parallel and are supplied with a common, one-track feeding stream of objects, which is divided over said two revolving tables and which is again combined, behind said revolving tables, to a one-track row.

35. Device according to claim 30, wherein the top side of said placement surface is shaped to the contour of the standing surface of the objects (F).

36. Device according to claim 16, wherein said spreading jaw unit (50) can be actuated by means of control elements (70) which are secured to the circumferential path of said spreading jaw units, and further said spreading jaw unit (50) can be moved by a peripheral cam (68) that can be swiveled, as desired, from a ready position into the spread position or vice versa.

* * * * *